United States Patent [19]

Speckter

[11] 4,148,033

[45] Apr. 3, 1979

[54] RADAR REFLECTOR FOR BUOYS AND OTHER FLOATING OBJECTS

[76] Inventor: Hans E. Speckter, Am Heyerberg 11, 5400 Koblenz 33, Fed. Rep. of Germany

[21] Appl. No.: 808,147

[22] Filed: Jun. 20, 1977

[51] Int. Cl.[2] ..... H01Q 15/18

[52] U.S. Cl. ..... 343/18 C

[58] Field of Search ..... 343/18 C

[56] References Cited

U.S. PATENT DOCUMENTS

| | | | |
|---|---|---|---|
| 1,384,014 | 7/1921 | Fessenden | 343/18 C |
| 2,310,790 | 2/1943 | Jungersen | 343/18 C |
| 2,405,990 | 8/1946 | Beechlyn | 343/18 C |
| 3,010,103 | 11/1961 | Hopper et al. | 343/18 C |
| 3,451,060 | 6/1969 | Edwards | 343/18 C |
| 4,028,701 | 6/1977 | Parks et al. | 343/18 C |
| 4,037,228 | 7/1977 | Pearson | 343/18 C |

*Primary Examiner*—Malcolm F. Hubler

[57] ABSTRACT

A radar reflector for buoys and other floating objects comprising six identical corner reflectors circumferentially evenly spaced about the main reflector axis. The axes of symmetry of said six corner reflectors define angles of about 90° with said main reflector axis and the apertures of said corner reflectors are outwardly directed and alternatingly disposed in inverted relation with respect to one another. The three plates of each corner reflector are enlarged up to the intersection lines with the plates of adjacent corner reflectors and to the intersection line, respectively, with an assumed cylinder surface circumscribing the total reflector assembly.

2 Claims, 5 Drawing Figures

RADAR REFLECTOR FOR BUOYS AND OTHER FLOATING OBJECTS

BACKGROUND OF THE INVENTION

1. Field of the Invention

This invention relates to a radar reflector in the type of a cluster reflector, comprising a plurality of corner reflectors in a specific configuration, which is particularly suited for use on buoys small ships and other floating objects. Its prominent properties are a very large radar cross section, a substantially omnidirectional back scatter characteristic in the angular range of concern and a high mechanical strength.

2. Description of the Prior Art

Since radar navigation began, numerous efforts have been made to improve the probability of detection of weakly reflecting targets in great distances and in clutter areas (sea and rain clutter). Various types of radar reflectors have been developed and mounted on buoys and other floating objects. However, considerable difficulties are experienced in designing radar reflectors with satisfactory radar (back scatter) and mechanical properties. For example, metallic spheres do have an omnidirectional characteristic, but their radar cross section, related to the sphere diameter, is extremely low. Omnidirectional dielectric lenses (Luneberg lenses) are unsuited for use in heavy sea areas because of their low mechanical strength.

For use on buoys and other floating objects, therefore almost precludingly so-called cluster reflectors have been employed comprising a plurality of corner reflectors in various configurations. The design of the cluster reflectors permits an adaption to heavy-duty conditions in the maritime area, but the radar properties of the cluster reflectors developed up to now are expressively poor.

SUMMARY OF THE INVENTION

The object of the present invention is to avoid the foregoing defects and disadvantages and to provide an improved radar reflector of a cluster type with the following properties:

(a) an almost complete angular coverage (omnidirectional back scatter characteristic) within a solid angle of azimuthal 360°, and vertical about ±25° to ±30°.

(b) a very large radar cross section with respect to the reflector diameter.

(c) a good mechanical strength and high resistance against influences of the sea environment.

A vertical angular coverage of ±25° to ±30° is entirely sufficient for all floating objects since even small targets like buoys do not exhibit a larger tilt angle (roll and pitch angle) in a rough sea.

The foregoing and other objects are achieved in accordance with the present invention through the provision of a radar reflector comprising six identical corner reflectors circumferentially evenly spaced about the main reflector axis. The axes of symmetry of said six corner reflectors define angles of about 90° with said main reflector axis and the apertures of said corner reflectors are outwardly directed and alternatingly disposed in inverted relation with respect to one another. The three plates of each corner reflector are enlarged up to the intersection lines with the plates of adjacent corner reflectors and to the intersection line, respectively, with an assumed cylinder surface circumscribing the total reflector assembly.

A radar reflector constructed in this way occupies a minimum of space, gives an outstanding radar performance, and has an excellent mechanical strength when adjacent corner reflectors are firmly secured along their intersection lines.

BRIEF DESCRIPTION OF THE DRAWINGS

The objects, features and advantages of the present invention will be more fully appreciated as the radar reflector becomes better understood from the following detailed description of the present invention when considered in connection with the accompanying drawings in which.

DETAILED DESCRIPTION OF THE PREFERRED EMBODIMENTS

Figure 1:
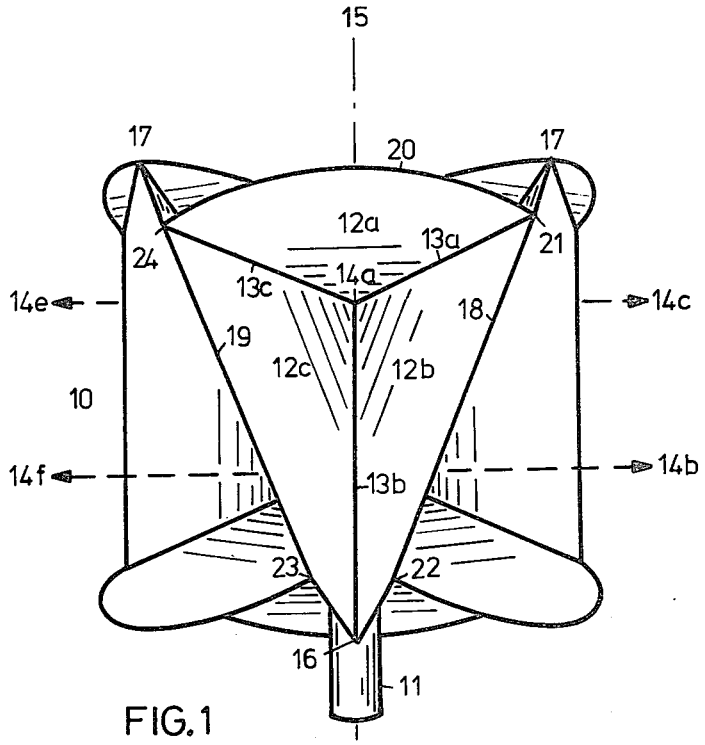
FIG. 1 is a side elevational view of the preferred embodiment of this invention.

Referring now to the drawings and more particular to FIG. 1 wherein the invented radar reflector, designated in its entirety by reference numeral 10, is mounted on a vertical pole or tube 11. The radar reflector comprises six identical corner reflectors that are circumferentially evenly arranged about the main reflector axis 15. Each corner reflector consists of three plates **12*a*, 12*b*, and 12*c*. Each plate is perpendicularly disposed to the others and firmly secured at the inner intersection lines 13*a*, 13*b* and 13*c*, respectively. The axes of symmetry 14*a*, 14*b*, 14*c*, 14*d*, 14*e* and 14*f*** of the six corner reflectors define angles of approximately 90° with said main reflector axis and are equally spaced at 60° intervals in the azimuthal plane, assuming a vertical orientation of the main reflector axis. The axis of symmetry is defined as being that axis which passes through the apex of the corner reflector, forming identical angles of 35.3° with each of the three plates.

Figure 2:
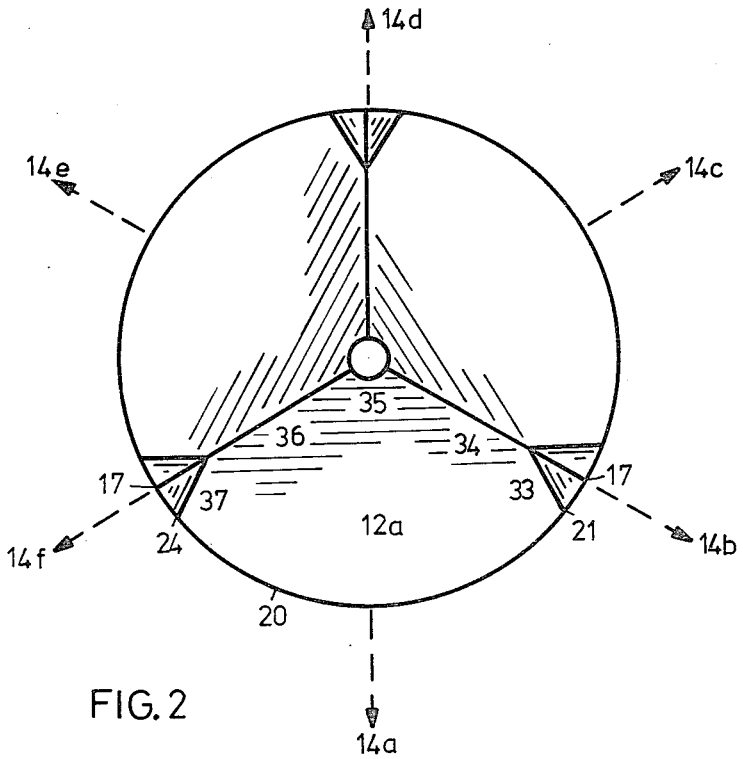
FIG. 2 is a top plan view of the embodiment of FIG. 1.
Figure 3:
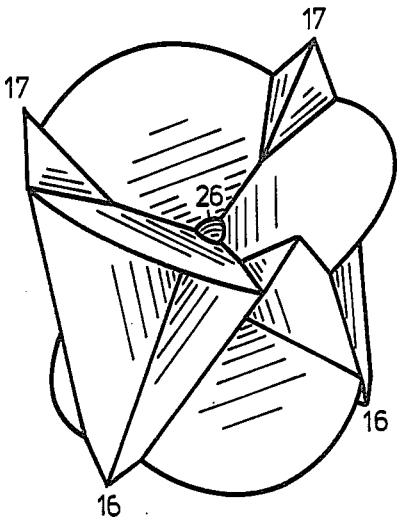
FIG. 3 is a perspective view of the embodiment of FIG. 1.

The plates of each corner reflector form an aperture outwardly directed with respect to said main reflector axis. When advancing in an azimuthal direction, the six apertures of said corner reflectors are alternatingly disposed with one vertex 17 directed upwardly and the next vertex 16 downwardly. Two plates **12*b* and 12*c* of each corner reflector are enlarged up to the outer edges 18 and 19 generated by the intersection of plates of adjacent corner reflectors. The third plate 12*a* of each corner reflector in enlarged approximately up to the outer edge 20 caused by the intersection with the surface of an assumed cylinder circumscribing the total reflector assembly, wherein the cylinder surface passes through the intersection points 21, 22, 23 and 24, generated by the intersections of the inner and outer intersection lines. As shown in FIG. 2 and 3 the third plate 12*a* of each corner reflector may in addition be enlarged up to the intersection lines 33, 34, 35, 36 and 37** with adjacent corner reflectors and the central mounting pole or tube.

Figure 4:
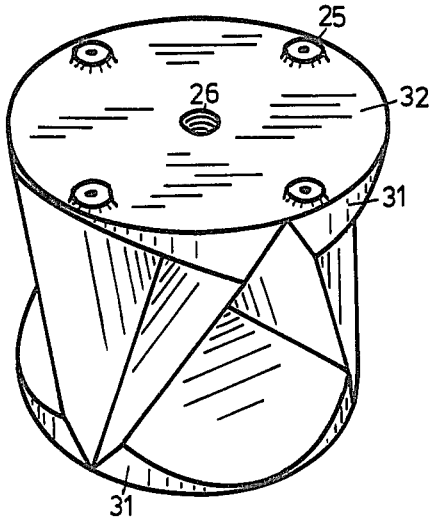
FIG. 4 shows a perspective view of another embodiment of the present invention.
Figure 5:
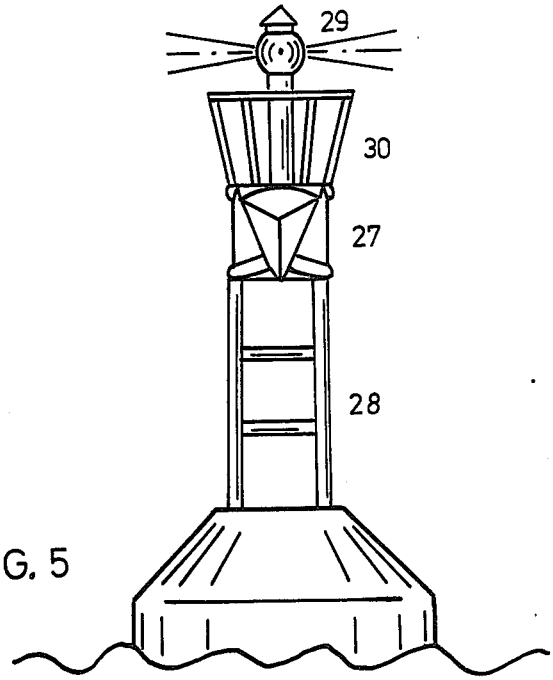
FIG. 5 illustrates as an example of an application, the incorporation of the invented radar reflector into the superstructure of a lighted buoy.

If the plates of said six corner reflectors are firmly secured to each other at the intersection lines, for example by spot or line welding, a reflector construction of an extremely high mechanical strength will result. The radar reflector may for instance be incorporated into the superstructure of a lighted buoy as a supporting element, as illustrated in FIG. 5, wherein the radar reflector module 27 is mounted between the lantern tower 28 and the lantern 29 with its surrounding structure 30. For such a buoy structure an embodiment of the present invention shown in FIG. 4 is particularly well suited in which the radar reflector is incorporated into a cylindrical body with its convex surface 31 and planar faces 32 at its top and bottom. Such a radar reflector can be used as a standardized module for various types of buoys since the planar faces of the cylindrical body can advantageously be used as a mounting platform. For example, in FIG. 4 the platform 32 is shown with four threaded flanges 25. If the power supply lines of the lantern have to pass through the radar reflector, a tube 26 can be arranged coaxially with the main reflector axis.

A completely tight surface of the reflector embodiment shown in FIG. 4, achieved for example by line welding along the intersection lines, will prevent the penetration of water or humidity into the interior of the radar reflector. Thus, a gradual destruction from the interior, as a result of corrosion, is prevented, and low overall maintenance costs of the radar reflector can be expected.

If a low weight is of particular importance, the radar reflector can be fabricated of light-weight plastics (foam plastics) with a metallic coating on the outer surface. Such a construction can readily protected by a radome of a simple cylindrical shape. Furthermore, the radome has the advantage of reducing the wind-load of the reflector and the radome surface can be used for the buoy marking.

The outstanding radar performance of the radar reflector according to the invention is due to the combined action of the following features:

(1) The largest possible radar cross section to be accommodated in a predetermined cylindrical volume results from the enlarged size and unique shape of the corner reflector apertures selected according to this invention.

(2) Due to the arrangement of the axes of symmetry of each corner reflector perpendicular to the main reflector axis the maximum of the radar cross section occurs at the statistically most probable attitude of the radar reflector (when the radar reflector is mounted on a floating object with its main axis in a vertical attitude).

(3) Six evenly spaced corner reflectors with considerably enlarged and alternatingly inverted apertures yield the optimum angular coverage within a solid angle of azimuthal 360°, and vertical ±30°. Interference effects ("hollows" in the beackscatter diagram) are confined to a few narrow angular zones.

The invention may be embodied in other specific forms without departing from the spirit or essential characteristics thereof. The embodiments are to be considered in all respects as illustrative and not restrictive.

What is claimed as new and desired to be secured by Letters Patent of the United States is:

1. A radar reflector of the kind referred to comprising six identical corner reflectors circumferentially evenly arranged about the main reflector axis, said corner reflectors being made of three plates each perpendicularly joined to one another, with the axes of symmetry of said corner reflectors being equally spaced at 60° intervals in the azimuthal plane, assuming a vertical orientation of said main reflector axis, and forming angles of approximately 90° with main reflector axis, the apertures of said corner reflectors being outwardly directed and disposed in inverted relation to one another when advancing in azimuthal direction, two of said plates of each corner reflector being enlarged up to the intersection lines with the plates of adjacent corner reflectors and one of said plates being enlarged approximately up to the intersection line with an assumed cylindrical surface circumscribing the total reflector assembly, where said cylindrical surface passes through intersection points generated by the inner and outer intersection lines of said plates.

2. A radar reflector according to claim 1 wherein the radar reflector is incorporated into a cylindrical body that closely circumscribes the radar reflector.

* * * * *